United States Patent [19]

Leach et al.

[11] Patent Number: 4,979,081

[45] Date of Patent: Dec. 18, 1990

[54] ELECTRICAL SUPPLY SYSTEM

[75] Inventors: Dennis Leach, Hertfordshire; Clive Dinmore, Chelmsford, both of United Kingdom

[73] Assignee: Courtney Pope Lighting Limited, London, United Kingdom

[21] Appl. No.: 446,550

[22] Filed: Dec. 7, 1989

[51] Int. Cl.[5] ..... H01R 33/00

[52] U.S. Cl. ..... 362/219; 362/220; 362/225; 362/226; 439/111

[58] Field of Search ..... 362/219, 220, 225, 226; 438/110, 111, 112, 117, 389, 391

[56] References Cited

U.S. PATENT DOCUMENTS

| | | | |
|---|---|---|---|
| 3,824,522 | 6/1974 | Bertrams et al. . | |
| 3,980,368 | 9/1976 | Fremont . | |
| 4,204,273 | 5/1980 | Goldberg | 362/219 |
| 4,482,944 | 11/1984 | Roossine et al. | 362/220 |
| 4,655,520 | 4/1987 | Cummings . | |
| 4,768,964 | 9/1988 | Zucchini | 439/110 |
| 4,778,397 | 10/1988 | Contant et al. . | |
| 4,845,601 | 7/1989 | Podbury et al. | 439/110 |

FOREIGN PATENT DOCUMENTS

| | | |
|---|---|---|
| 331441 | 4/1903 | France . |
| 352797 | 8/1905 | France . |
| 394199 | 6/1933 | United Kingdom . |
| 1172149 | 11/1969 | United Kingdom . |
| 1302502 | 1/1973 | United Kingdom . |

*Primary Examiner*—Ira S. Lazarus
*Assistant Examiner*—Richard R. Cole
*Attorney, Agent, or Firm*—Beveridge, DeGrandi & Weilacher

[57] ABSTRACT

The invention relates to an electrical supply system for electrical lighting installations and the like. The system comprises a track having an elongate insulating member housing first and second conductors extending longitudinally in spaced apart relationship and a plurality of like connectors each having attachment means operable to attach the connector to the track at a continuously adjustable position along its length and contact means making electrical contact with the track when so attached. Each connector is selectively attachable in either a first or a second orientation relative to the track such that the contact means makes electrical contact with only the first or second conductor respectively. Such an arrangement allows the connectors to be of simple construction and can be used with any number of different electrical loads.

10 Claims, 6 Drawing Sheets

ELECTRICAL SUPPLY SYSTEM

This invention relates to an electrical supply system and in particular but not exclusively to a supply system for electrical lighting installations.

It is known to provide an electrical supply system in which a connector forming part of a housing of a lamp is attachable to a supply track at a continuously adjustable position along the length of the track so as to make electrical contact with conductors housed in the track.

Known connectors of this type include complex arrangements to make separate mechanical and electrical connection with the track and include two or more electrical contacts cooperating with a corresponding number of track conductors to supply power to the lamp.

According to the present invention there is disclosed an electrical supply system comprising a track having an elongate insulating member housing first and second conductors extending longitudinally in spaced apart relationship and a plurality of like connectors each having attachment means operable to attach the connector to the track at a continuously adjustable position along its length and contact means making electrical contact with the track when so attached, wherein each connector is selectively attachable in either a first or a second orientation relative to the track such that the contact means makes electrical contact with only the first or second conductor respectively.

Preferably each connector includes support means operable to provide mechanical and electrical connection with a terminal of an electrical load whereby in use the electrical load may be connected between first and second connectors attached to the track in the first and second orientations respectively to complete a current carrying circuit between the conductors.

An advantage of such an arrangement is that the connectors can be of simple construction and can be used with any number of different electrical loads.

Advantageously the insulating member of the track defines first and second channels and each connector comprises a sheet of resilient metallic material having longitudinally extending first and second edge portions resiliently biassed into the channels thereby constituting the attachment means, the channels being partially occupied by the first and second conductors respectively and the edge portions being of unequal lateral extent such that only the first edge portion makes contact with one of the first and second conductors to thereby constitute the contact means.

Conveniently the insulating member comprises a strip of flexible plastics material formed as a unitary extrusion or moulding.

An advantage of such an arrangement is that the track including the conductors can be cut to any required length and can be bent to conform to a supporting surface as may be required.

Preferably the strip has inturned edge portions defining the first and second channels, each inturned edge portion having a part cylindrical surface for holding a conductor of circular cross-section and a lip inclined at an angle to the strip such that each channel tapers in a direction away from its respective conductor.

Preferably the connector includes a central portion which is part circular when viewed in longitudinal projection and everted side portions on each side of the central portion extending substantially at right angles to the strip when the connector is attached to the insulating member, each side portion having an inturned foot terminated by a respective one of the edge portions which are outturned to extend into the respective channels.

An advantage of this arrangement is that the edge portions of the connector when inserted into the channels are retained in a stable position by virtue of the taper imparted to the channel by the inclined lips. The connector may preferably be arranged such that the feet are biassed laterally apart so as to be positively biassed into the channels.

Advantageously each connector includes at least one transversely extending cutout dividing the central portion into longitudinally spaced terminal gripping portions which are capable of radial flexure substantially independently of those terminal gripping portions from which they are longitudinally separated.

This enables more than one terminal to be connected to a given connector without disrupting the way in which other terminals are gripped by the connector.

Preferably the difference between the first and second orientations corresponds to a rotation of the connector through 180° about an axis at right angles to the longitudinal axis of the track and each connector includes means indicating to the user the selected orientation of the connector with respect to the track.

Conveniently each connector is adapted to make mechanical and electrical connection to one end of a festoon light bulb.

The supply system may be provided with a lamp cooperable with adjacent first and second connectors oriented in first and second orientations relative to the track respectively, the lamp comprising a housing supporting first and second terminals engageable with the first and second connectors respectively and a socket receiving in use a light bulb.

Conveniently the housing includes a swivel joint facilitating swivelling movement of the socket and light bulb relative to the track.

Particular embodiments of the present invention will now be described by way of example only and with reference to the accompanying drawings of which:

Figures 1, 2:
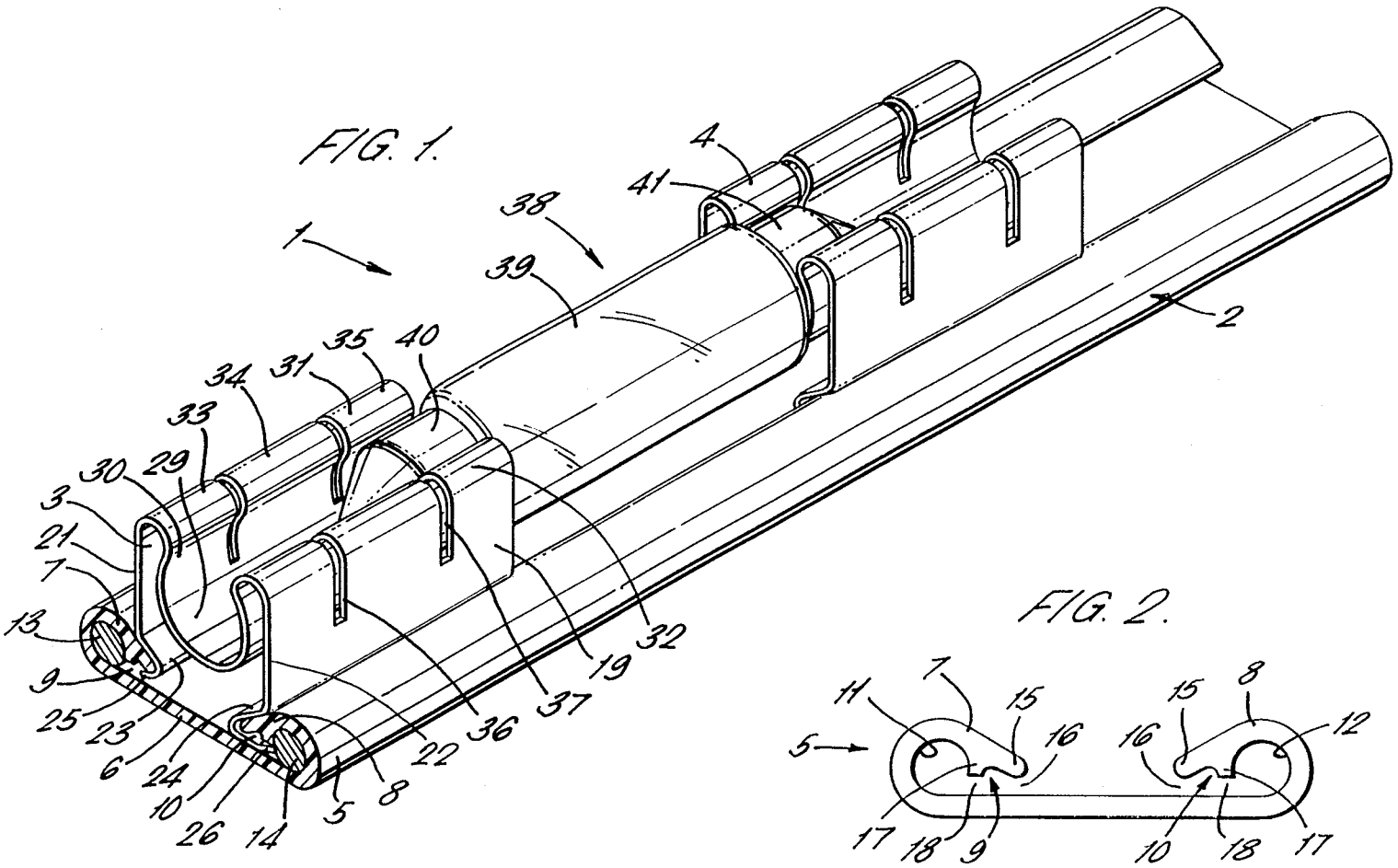
FIG. 1 is a perspective view of a track fitted with first and second connectors connected to a festoon light bulb.
FIG. 2 is an end view of an insulating member of the track of FIG. 1.

FIG. 1 shows an electrical supply system 1 comprising a track 2 and first and second connectors 3 and 4. The track 2 comprises an elongate insulating member 5 which is extruded from a flexible plastics material having electrically insulating properties. The insulating member 5 comprises a flat strip 6 having inturned left and right edge portions 7 and 8 defining laterally opposed left and right channels 9 and 10 respectively. The insulating member 5 is symmetrical about its longitudinal axis and the terms left and right in the present context refer to the orientation viewed in FIG. 1.

The insulating member 5 is shown in end view in FIG. 2. The left and right edge portions 7 and 8 define part cylindrical surfaces 11 and 12 respectively of the left and right channels 9 and 10 which captively grip left and right cylindrical conductors 13 and 14 respectively as shown in FIG. 1.

Each of the left and right edge portions 7 and 8 has a lip 15 which is inclined at an angle to the plane of the flat strip 6 such that each respective channel 9 and 10 has a mouth 16 defined between the lip 15 and the strip 6 and which increases in size progressively towards the respective conductor 13,14. Each of the left and right edge portions 7 and 8 also includes a projection 17 which projects from the lip 15 towards the strip 6 intermediate the mouth 16 and the respective conductor 13, 14 to define a constricted opening 18.

Figure 4:
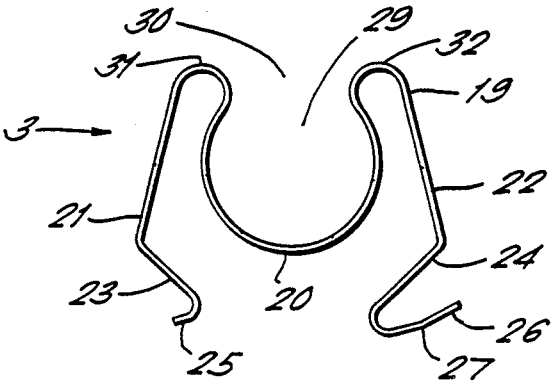
FIG. 4 is an end view of the connector of FIG. 3.
Figure 5:
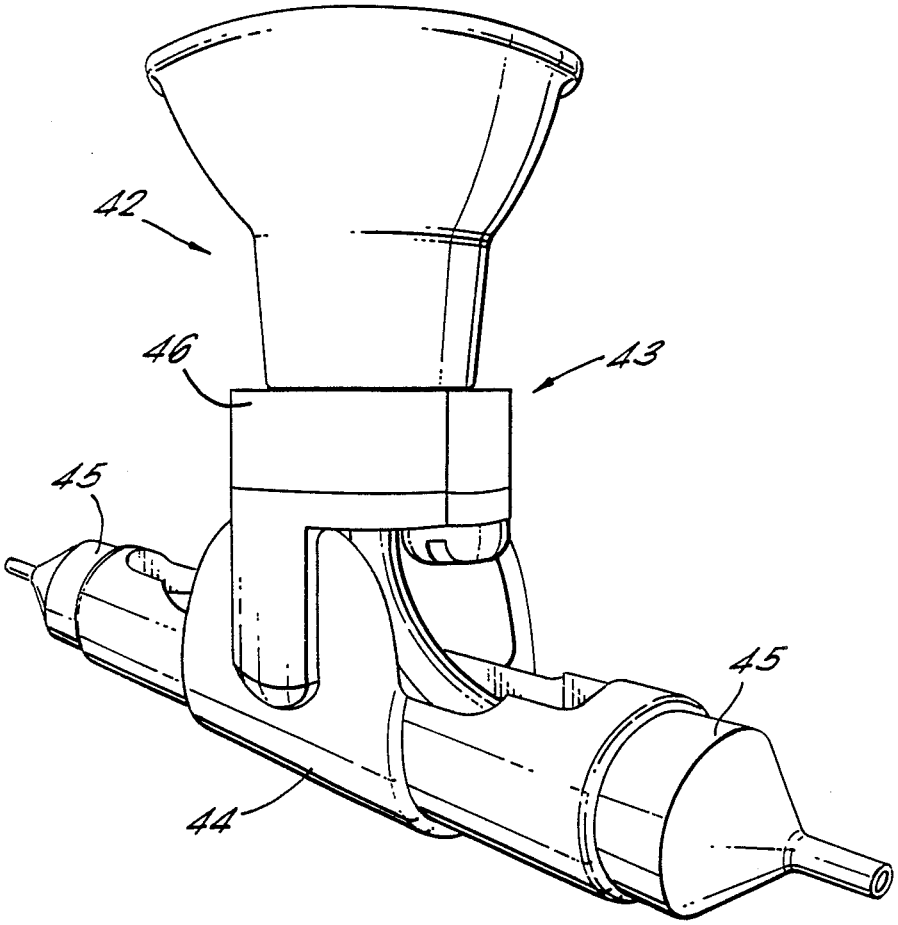
FIG. 5 is a perspective view of a lamp having a housing with a swivel joint.

The first connector 3 comprises a tin plated spring steel sheet 19 which has a shape memory as shown in FIG. 4 and is resiliently deformable. The first connector 3 is of uniform lateral cross-section and in its undeformed shape as shown in FIG. 4 has a central portion 20 of part circular cross-section and everted left and right side portions 21 and 22 each having a respective inturned foot 23 and 24 terminated by a respective left and right edge portion 25 and 26.

The right edge portion 26 is longer than the left edge portion 25 and includes a bend 27 so as to be slightly upturned.

Figure 3:
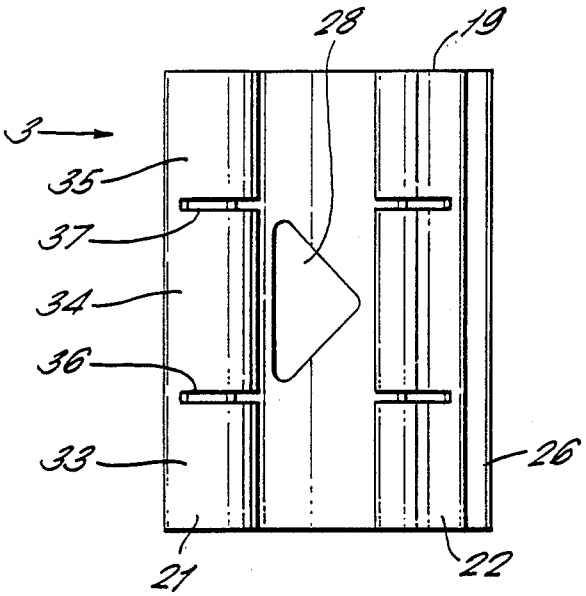
FIG. 3 is a plan view of a first connector of FIG. 1.

As seen in plan view in FIG. 3 a triangular cut-out 28 is formed centrally in the sheet 19 and oriented so as to have the appearance of a pointer directed to the right side portion 22.

As seen in FIG. 4 the central portion 20 defines a part cylindrical cavity 29 having a mouth portion 30 bounded by left and right gripping portions 31 and 32 respectively constituted by the everted sheet 19. The gripping portions 31 and 32 are divided longitudinally into first, second and third portions 33, 34 and 35 respectively by transverse slots 36 and 37.

The second connector 4 is of identical construction to the first connector 3 and corresponding reference numerals are used for corresponding elements throughout.

The supply system 1 is shown in use in FIG. 1 to supply electrical current to a festoon light bulb 38 comprising a cylindrical glass bulb 39 having first and second cylindrical terminals 40 and 41 respectively at opposite axial extremeties of the bulb.

In use to connect the festoon light bulb 38 to the supply system 1 the first connector 3 is attached to the track 2 by a user manually pressing the left and right side portions 21 and 22 together and presenting the connector to the track such that the left and right edge portions 25 and 26 of the sheet 19 are aligned with the respective mouths 16 of the left and right channels 9 and 10. The user then releases the connector so that the side portions 21 and 22 resile outwardly such that the edge portions 25 and 26 enter the respective left and right channels 9 and 10. The first connector may be attached to the track in this manner at any position along the length of the track and may be adjusted in position by first compressing slightly the side portions 21 and 22 and sliding the connector to any desired continuously adjustable position.

In this attached position as shown in FIG. 1 the right-hand edge portion 25 of the connector 3 extends through the mouth 16 of the channel 10 and through the constricted opening 18 into contact with the right conductor 14. The left edge portion 25 of the first conductor 3 is shorter and therefore extends into the left channel 9 to a lesser extent and extends through the mouth 16 but does not extend through the constricted opening 18. The first connector 3 therefore makes electrical contact only with the right conductor 14 and is electrically isolated from the left conductor 13.

The user then attaches the second connector 4 to the track 2 in like manner except that the second connector is oriented such that the triangular cut-out 28 points in the opposite direction i.e. rotated through 180° from the position shown in FIG. 3 about an axis at right angles to the strip 6.

In this orientation the second connector 4 makes electrical contact only with the left conductor 13 and is electrically isolated from the right conductor 14. The first and second connectors 3 and 4 are spaced longitudinally by a distance corresponding to the length of the glass bulb 39 and the first and second terminals 40 and 41 are inserted into the respective mouth portions 30 of the first and second connectors 3 and 4 so as to be gripped between left and right gripping portions 31 and 32. During insertion the gripping portions 31 and 32 are outwardly deformed and resile to positively grip and make electrical contact with the terminals 40 and 41. As shown in FIG. 1 the first and second connectors 3 and 4 are attachable to the track 2 in distinct first and second orientations respectively relative to the track such that when the conductors 13 and 14 are connected to a power supply the first and second connectors will receive voltages of different polarity. Further pairs of connectors can be added as required at different positions along the track to connect further light bulbs or other electrical loads having terminals compatible with the shape of the connectors.

The transverse slots 36 and 37 enable the first and third portions 33 and 35 of the gripping portions 31 and 32 to flex independently so that a connector may receive at opposite ends two separate terminals of two adjacent light bulbs (not shown). A series of such attachments may be made along the length of the track provided the successive connectors are alternatingly oriented to provide alternating polarities.

Figure 6:
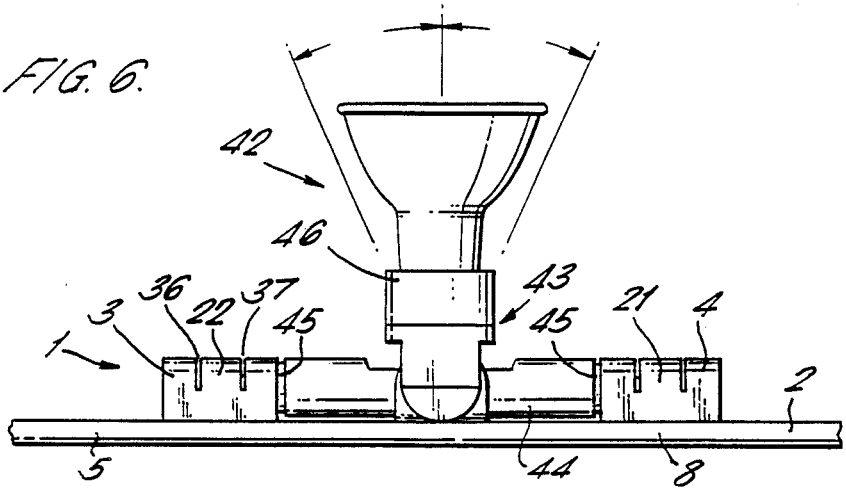
FIG. 6 is a side view of an alternative lamp.

The track 2 and connectors 3 and 4 may be used to supply an alternative lamp 42 as shown in FIG. 6. The lamp 42 comprises a housing 43 having a base 44 extending longitudinally with respect to the track, each end of the base terminating in an electrical terminal 45 of cylindrical external shape adapted to be gripped by first and second connectors 3 and 4 respectively.

The housing 43 also has a lamp socket 46 receiving a light bulb (not shown) and pivotally connected to the base 44 such that the lamp socket can be swivelled relative to the track 2.

Figure 7:
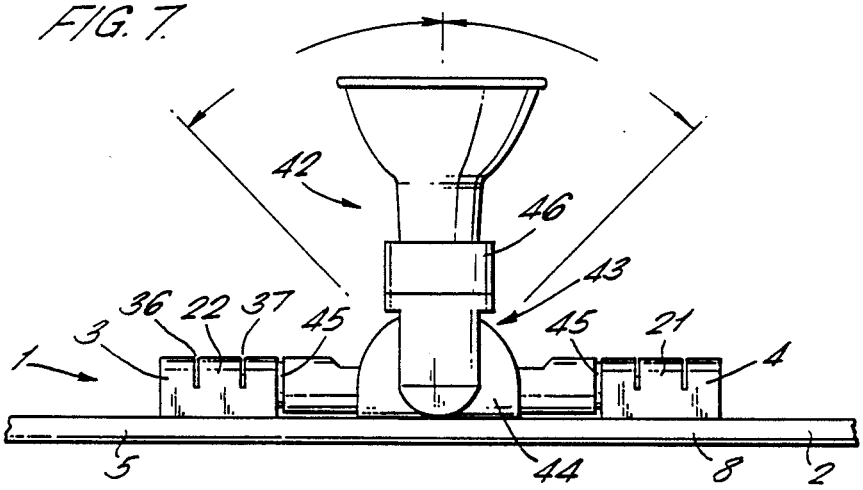
FIG. 7 is a side view of a further alternative lamp.
Figure 8:
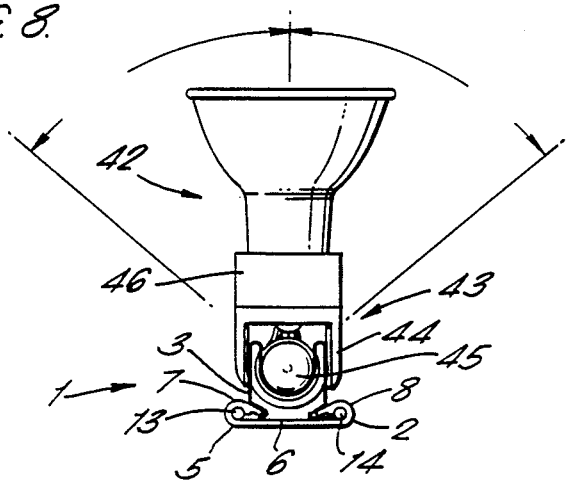
FIG. 8 is an end view of a further alternative lamp.

Alternative configurations of the lamp 42 are shown in FIGS. 7 and 8.

Figure 9:
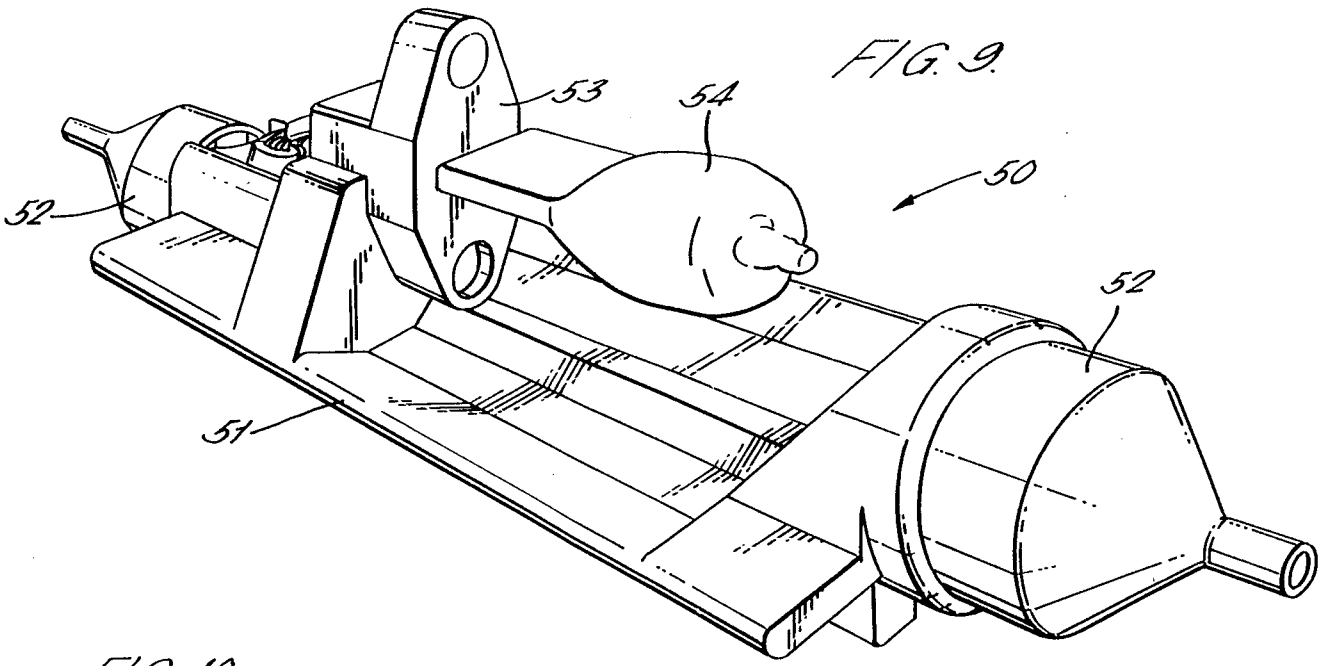
FIG. 9 is a perspective view of a further alternative lamp having a quartz halogen light bulb.
Figure 10:
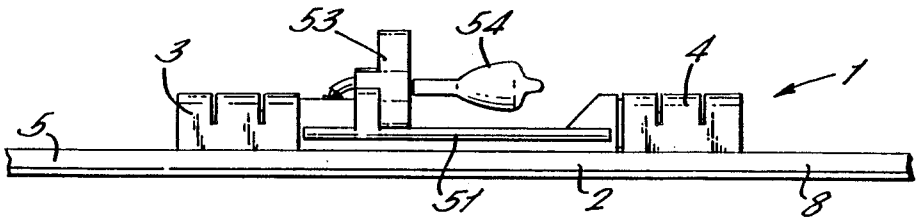
FIG. 10 is a side view of the lamp of FIG. 9 fitted to a track by means of first and second connectors.

A further alternative lamp 50 is shown in FIG. 9 in which the lamp has a body 51 extending longitudinally with the track 2 and having longitudinally opposed terminals 52 of cylindrical outer shape. The lamp 50 is connected between adjacent first and second connectors 3 and 4 by inserting the respective terminals 52 between the cooperating gripping portions 31 and 32 of each connector. The body 51 includes a lamp socket 53 receiving a quartz halogen light bulb 54.

Figure 11:
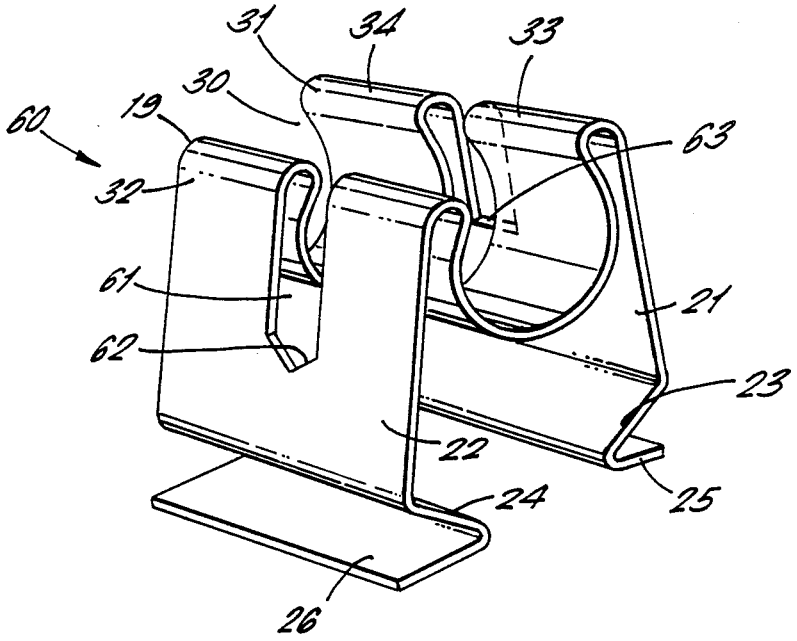
FIG. 11 is a perspective view of an alternative connector for use with the track shown in FIG. 1.

FIG. 11 shows an alternative connector 60 for use with the track 2 of previous FIG.s and corresponding reference numerals are used in describing the connector 60 to those of previous Figures where appropriate for corresponding elements.

The connector 60 has a single transverse slot 61 which divides left and right gripping portions 31 and 32 into first and second portions 33 and 34 respectively.

The slot 61 has a first end 62 located in the right gripping portion 32 and this first end is shaped pointedly. The slot 61 has a second end 63 located in the left gripping portion 31 and is square ended in shape. The first end 62 is therefore distinguishable from the second end 63 and serves to identify to the user the location of a right gripping portion 32 and hence its associated electrically contacting edge portion 26.

The alternative connector 60 functions in like manner to the first and second connectors 3 and 4 and a plurality of such connectors 60 can be used with the track 2 for supplying power to the festoon light bulb 38 or lamps 42, 50 as described above with reference to previous Figures.

The supply systems described above will generally be used with low voltage applications and typically include a low voltage transformer to enable mains power to be supplied at 12 or 24 volts between the left and right conductors 13 and 14.

The insulating member 5 may be formed of a soft flexible plastics material such that the track can be bent to conform to contours of a supporting surface and the strip 6 can be readily pierced by a drill to facilitate insertion of screws at any desired position along the length of the track.

The track 2 may alternatively be adhesively secured to a supporting surface.

The track may alternatively be formed of a rigid plastics material such as polyvinyl chloride.

What is claimed:

1. An electrical supply system comprising a track having an elongate insulating member defining first and second channels and first and second electrical conductors housed in the first and second channels respectively so as to extend longitudinally of the track in spaced apart relationship, the supply system further comprising a plurality of like connectors each having attachment means operable to attach the connector to the track at a continuously adjustable position along its length and contact means making electrical contact with the track when so attached, and wherein each connector comprises a sheet of resilient metallic material having longitudinally extending first and second edge portions, the sheet being shaped by bending such that the edge portions are insertable into the channels and having a shape memory such that when inserted the edge portions are resiliently biased into the channels to thereby constitute the attachment means, the channels being partially occupied by the first and second conductors respectively and the edge portions being of unequal lateral extent such that only the first edge portion makes contact with one of the first and second conductors to thereby constitute the contact means, whereby each connector is selectively attachable in either a first or second orientation relative to the track such that the contact means makes electrical contact with only the first or second conductor respectively.

2. An electrical supply system as claimed in claim 1 wherein each connector includes support means operable to provide mechanical and electrical connection with a terminal of an electrical load whereby in use the electrical load may be connected between first and second connectors attached to the track in the first and second orientations respectively to complete a current carrying circuit between the conductors.

3. An electrical supply system as claimed in claim 1 wherein the insulating member comprises a strip of flexible plastics material formed as a unitary extrusion or moulding.

4. An electrical supply system as claimed in claim 3 wherein the strip has inturned edge portions defining the first and second channels, each inturned edge portion having a part cylindrical surface for holding a conductor of circular cross-section and a lip inclined at an angle to the strip such that each channel tapers in a direction away from its respective conductor.

5. An electrical supply system as claimed in claim 1 wherein the connector includes a central portion which is part circular when viewed in longitudinal projection and everted side portions on each side of the central portion extending substantially at right angles to the strip when the connector is attached to the insulating member, each side portion having an inturned foot terminated by a respective one of the edge portions which are outturned to extend into the respective channels.

6. An electrical supply system as claimed in claim 1 wherein each connector includes at least one transversely extending cutout dividing the central portion into longitudinally spaced terminal gripping portions which are capable of radial flexure substantially independently of terminal gripping portions from which they are longitudinally separated.

7. An electrical supply system as claimed in claim 1 wherein the difference between the first and second orientations corresponds to a rotation of the connector through 180° about an axis at right angles to the longitudinal axis of the track and each connector includes means indicating to the user the selected orientation of the connector with respect to the track.

8. An electrical supply system as claimed in claim 1 wherein each connector is adapted to make mechanical and electrical connection to one end terminal of a festoon light bulb.

9. An electrical supply system as claimed in claim 1 including a lamp co-operable with adjacent first and second connectors oriented in first and second orientations relative to the track respectively, the lamp comprising a housing supporting first and second terminals engageable with the first and second connectors respectively and a socket receiving in use a light bulb.

10. An electrical supply system as claimed in claim 9 wherein the housing includes a swivel joint facilitating swivelling movement of the socket and light bulb relative to the track.

* * * * *